United States Patent [19]

Kawada

[11] Patent Number: 5,074,541

[45] Date of Patent: Dec. 24, 1991

[54] DEVICE FOR DISTRIBUTING FINISHED PHOTOGRAPHIC PAPER

[75] Inventor: Ken Kawada, Kanagawa, Japan

[73] Assignee: Fuji Photo Film Co., Ltd., Kanagawa, Japan

[21] Appl. No.: 403,239

[22] Filed: Sep. 1, 1989

[30] Foreign Application Priority Data

Sep. 5, 1988 [JP] Japan ..... 63-221661
Sep. 5, 1988 [JP] Japan ..... 63-221662

[51] Int. Cl.[5] ..... B65H 31/32

[52] U.S. Cl. ..... 271/189; 271/216; 414/790.8

[58] Field of Search ..... 414/790.8, 790.7; 271/189, 207, 216

[56] References Cited

U.S. PATENT DOCUMENTS 3,777,903 12/1973 Kuckhermann ..... 414/790.7
4,034,846 7/1977 Burgis ..... 414/790.7 X
4,456,239 6/1984 Yamaguchi ..... 271/189 X
4,465,270 8/1984 Amato ..... 271/216 X

FOREIGN PATENT DOCUMENTS 60-156556 10/1985 Japan .

*Primary Examiner*—Richard A. Schacher
*Attorney, Agent, or Firm*—Sughrue, Mion, Zinn, Macpeak & Seas

[57] ABSTRACT

A device for distributing finished photographic paper of the type in which finished photographic paper sheets discharged from a photographic-paper processing apparatus are transferred to a conveying belt by means of flappers, and are distributed and arranged on the conveying belt. The flappers are controlled in such a manner that they operate to transfer the finished photographic paper sheets selectively in conformance with the size of said photographic paper which are transferred to the conveying belt when a predetermined number of them have been accumulated on the flappers. And the distance of moving of the conveying belt is controlled when transferred to the conveying belt are arranged selectively in two modes, in one of which the piles of accumulated finished photographic paper sheets on the conveying belt is allowed to have an appropriate space between them, and in the other of which the piles partly overlap each other.

17 Claims, 5 Drawing Sheets

30
32
34
38
14
62
S3
36
S2
S1
12
16
18
20
22
24
26
28
27
10

DEVICE FOR DISTRIBUTING FINISHED PHOTOGRAPHIC PAPER

BACKGROUND OF THE INVENTION

1. Field of the Invention

This invention relates to a device for distributing finished photographic paper, and in particular to a device for distributing, according to orders, finished photographic paper, which is cut, by the image frame, in a photographic processing apparatus, such as a printer processor for printing and development, and discharged therefrom.

2. Description of the Related Art

A printer processor has conventionally been known which prints images recorded on negative film on photographic paper, cuts the paper by the image frame, develops and fixes the images, washes the paper sheets in water, and dries the sheets before discharging them. Arranged on the discharge side of this printer processor is a device for distributing finished photographic paper which serves to distribute sheets of finished photographic paper according to orders. In conventional devices for distributing finished photographic paper, such as the one disclosed in Japanese Utility Model Laid-Open No. 60-156556, a plurality of L-shaped fittings are attached to an endless belt and arranged at predetermined intervals, sheets of finished photographic paper being distributed by driving the endless belt in such a manner that each of the spaces defined between adjacent L-shaped fittings receives sheets of finished photographic paper corresponding to one order.

The problem with the conventional devices for distributing finished photographic paper is that they need a large number of parts due to the fact that a plurality of L-shaped fittings are mounted on them. Furthermore, they require a large space since the L-shaped fittings protrude therefrom in a direction perpendicular to the endless-belt surface.

SUMMARY OF THE INVENTION

This invention has been contrived with a view to eliminating the above-mentioned problems experienced with the prior art devices. It is accordingly an object of this invention to provide a device for distributing finished photographic paper which can be realized with a smaller number of parts and which can be installed in a narrow space.

In order to attain this object, this invention provides a device for distributing finished photographic paper, comprising a conveying belt having a length which allows a plurality of finished photographic paper sheets to be arranged in parallel thereon in the conveying direction, a first driving device for driving the above-mentioned conveying belt, flappers for transferring finished photographic paper sheets discharged from a processing apparatus to the above-mentioned conveying belt, a second driving device for driving the above-mentioned flappers, and a control means which controls the above-mentioned second driving device in such a manner that finished photographic paper sheets are transferred to the above-mentioned conveying belt when a predetermined number of them have been accumulated on the above-mentioned flappers, and which controls the above-mentioned first driving device in such a manner that piles of the accumulated finished photographic paper sheets, when transferred to the above-mentioned conveying belt, are conveyed for a predetermined distance.

This control means is capable of controlling the first driving device in such a manner that the conveying distance is varied in conformance with the size of the next group of finished photographic paper sheets to be sorted. Further, it is capable of controlling the second driving device in such a manner that the movement of the flappers is changed in conformance with the size of the finished photographic paper sheets.

The conveying belt of this invention has a length which allows a plurality of finished photographic paper sheets to be arranged in parallel thereon in the conveying direction, and is driven by the first driving device. The flappers, which are used for transferring finished photographic paper sheets discharged from the processing apparatus to the conveying belt, is driven by the second driving device.

The control means controls the second driving means in such a manner that finished photographic paper sheets are transferred to the conveying belt when a predetermined number of them have been accumulated on the flappers, and, at the same time, controls the first driving device in such a manner that the accumulated finished photographic paper sheets, when transferred to the conveying belt, are conveyed for a predetermined distance. As a result, piles of finished photographic paper sheets, each of which comprises a predetermined number of sheets, are arranged on the conveying belt, in parallel in the conveying direction, thus making it possible to distribute the finished photographic paper sheets.

Further, by changing the conveyance distance in conformance with the size of the finished photographic paper sheets by means of the above-mentioned control circuit, the photographic paper arranging surface of the conveying belt can be utilized efficiently.

Thus, in accordance with this invention, finished photographic paper sheets are transferred from a processing apparatus to a conveying belt by means of flappers, which allows the number of parts to be reduced and the installation space to be smaller.

Further, since the conveyance distance is changed in conformance with the size of the photographic paper sheets, the photographic paper arranging surface of the conveying belt can be utilized efficiently.

DETAILED DESCRIPTION OF THE PREFERRED EMBODIMENTS

Figure 1:
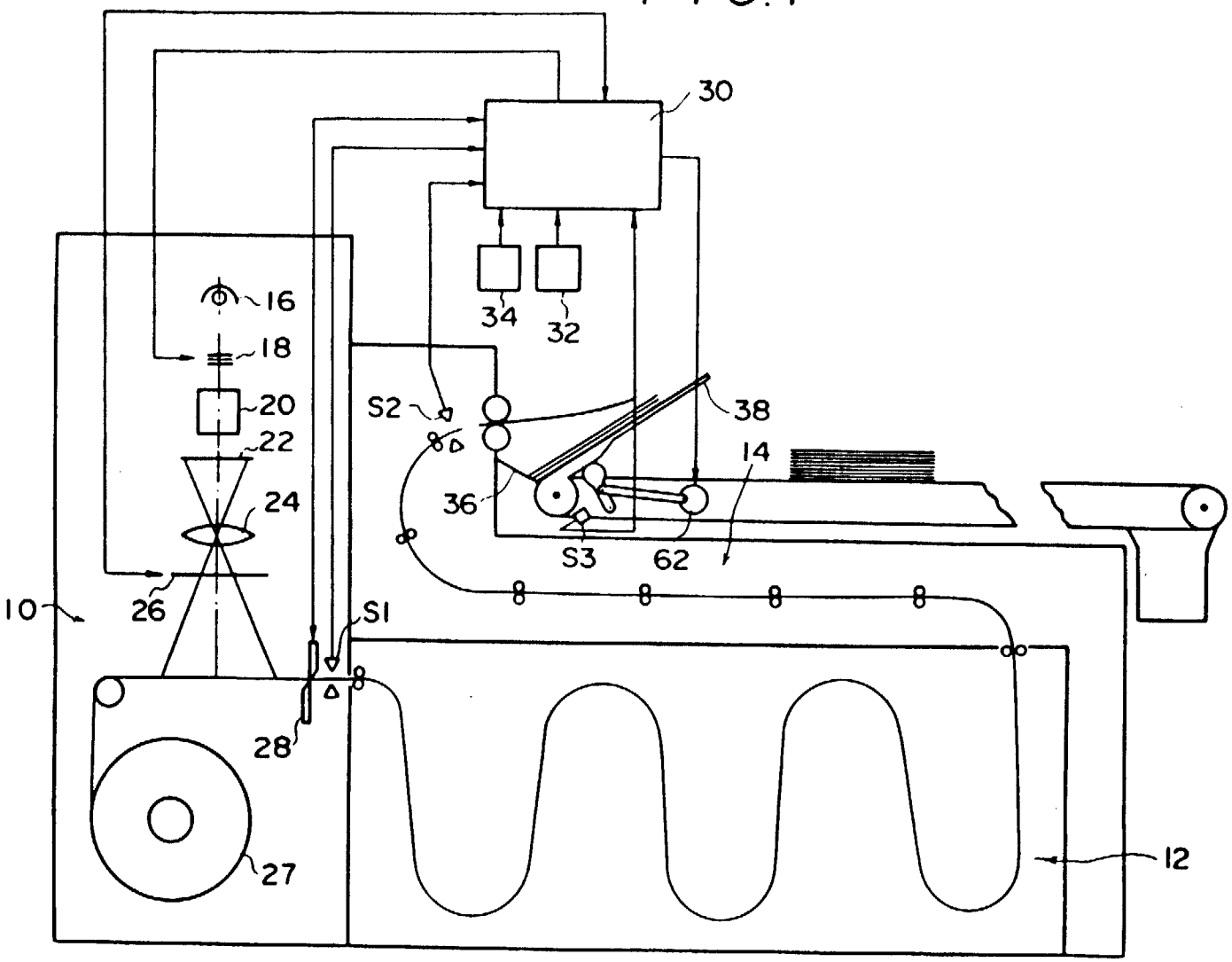
FIG. 1 is a schematic diagram showing a device for distributing finished photographic paper in accordance with an embodiment of this invention as arranged on the discharge side of a printer processor.

An embodiment of this invention will now be described in detail with reference to the accompanying drawings. The embodiment is shown as applied to a printer processor. As shown in FIG. 1, the associated printer processor comprises an exposure section 10 for printing images recorded on negative film on photographic paper, a developing/fixing/washing section 12 for the development, fixing and water washing of photographic paper with image printed thereon, and a drying section 14 for drying the photographic paper washed in water. Arranged successively in the exposure section 10 are a light source 16, a dimmer filter 18 composed of filters of the three complementary colors of Y, M and C, a light diffusion filter 20 for diffusing light, a lens 24 for printing, a black shutter 26, and photographic paper 27 in the form of a roll, negative film 22 being positioned between the light diffusion filter 20 and the lens 24. When images have been printed thereon, the photographic paper 27 is cut by a cutter 28 by the image frame before being discharged through the developing/fixing/washing section 12 and the drying section 14 to the exterior. Arranged on the output side of the cutter 28 is a first paper sensor S1 serving to detect photographic paper and composed of a light emitting and a light receiving element, on the output side of the drying section 14 is a second paper sensor S2 having a similar construction. Fixed on the discharge side of this printer processor is a catcher 36 which prevents finished photographic paper sheets from falling to the floor, the device for distributing finished photographic paper being arranged at a position close to this catcher 36.

Figure 2:
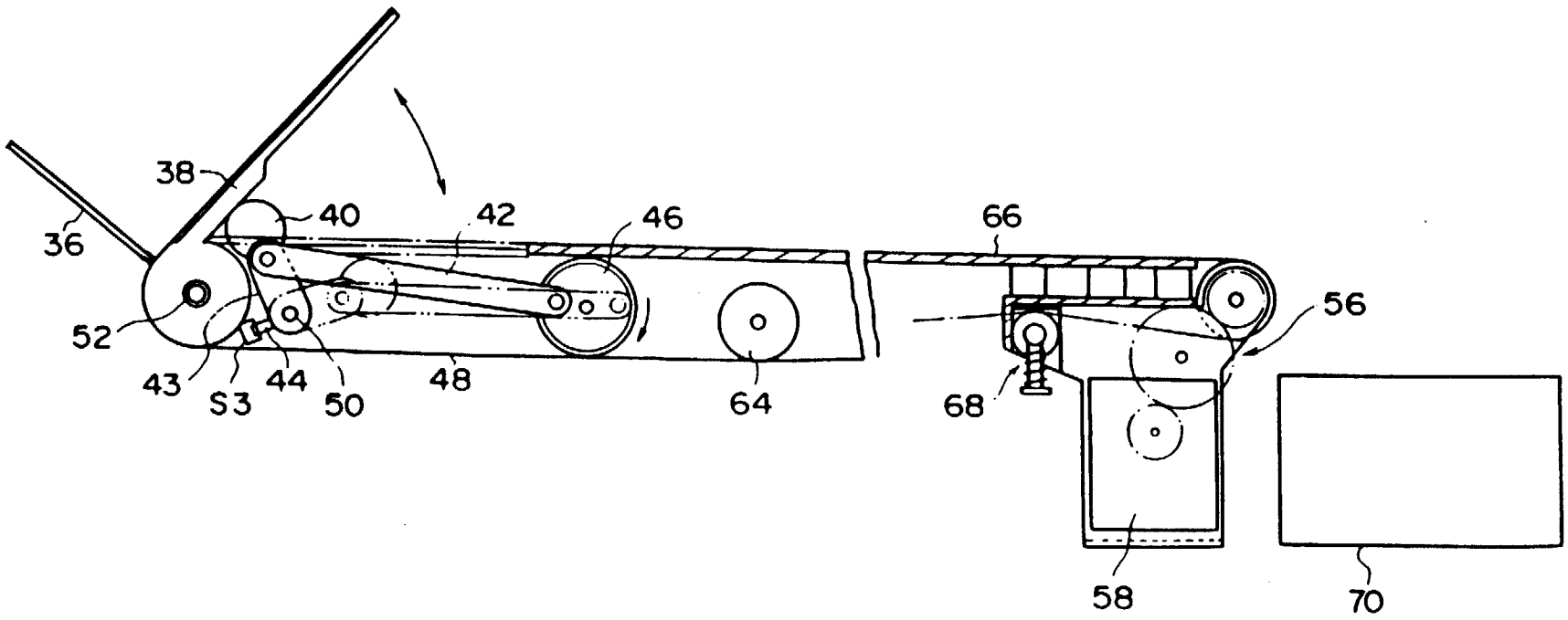
FIG. 2 is sectional view of the device shown in FIG. 1.
Figure 3:
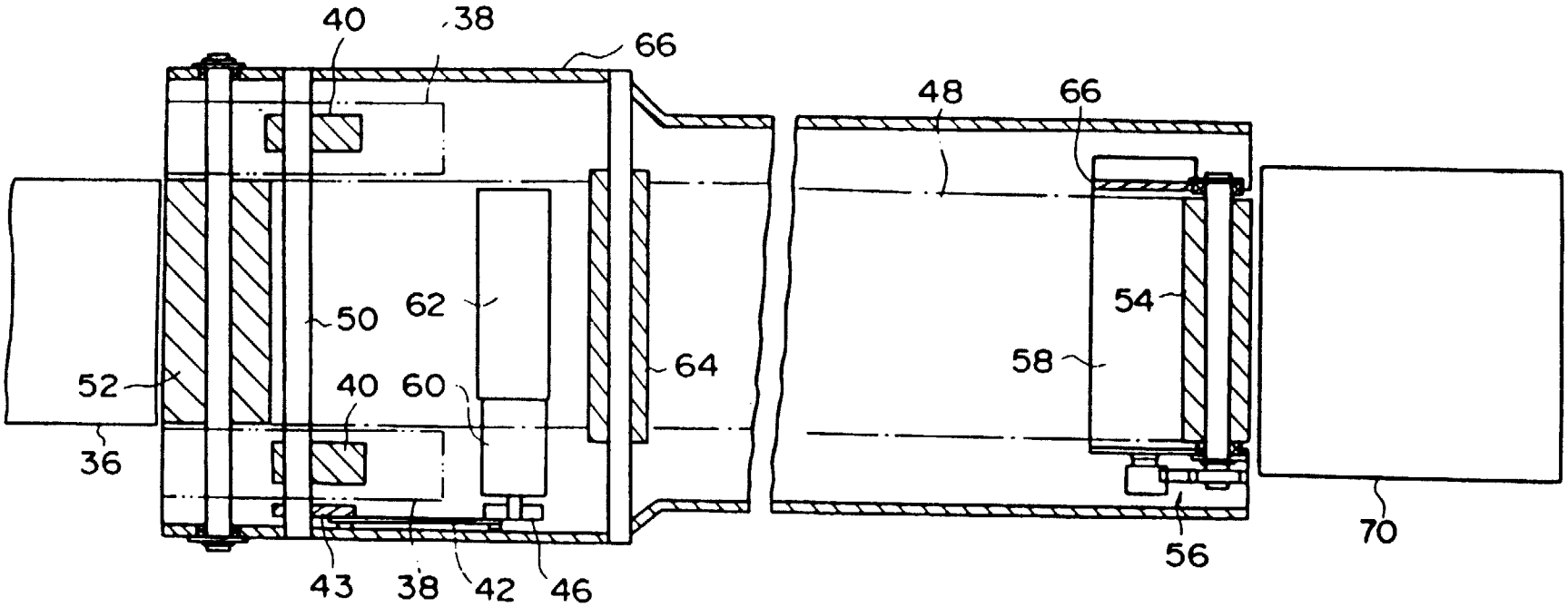
FIG. 3 is a plan view of the same.

As shown in FIGS. 2 and 3, the device for distributing finished photographic paper comprises a body 66. Rotatably supported on this body 66 are a driven roller 52 and a driving roller 54, between which an endless belt 48 is stretched. The axle of the driving roller 54 is connected to a driving motor 58 through a series of gears 56. The base sections of a pair of flappers 38 are mounted on the axle of the driven roller 52 in such a manner as to idle on it. A shaft 50 is rotatably supported by the body 66 in such a manner as to be parallel to the axle of the driven roller 52, and a pair of cams 40 are fixed at the end sections of this shaft 50 in such a manner as to face the flappers 38. Fixed to one end of the shaft 50 is one end of a first link 43. One end of a second link 42 is rotatably mounted on the other end of this first link 43. The other end of the second link 42 is rotatably mounted on a disc 46, at a position near the circumference thereof. This disc 46 is connected to a motor 62 through a gear box 60. Formed at one end of the first link 43 is a detection piece 44 which is detected, with the flappers 38 lowered, by a link sensor S3 composed of a light emitting and a light receiving element. With the above-described structure, the rotation of the disc 46 by the motor 62 causes the cams 40 to be swung around the shaft 50, thereby swinging the flappers 38 between the position indicated by the solid line of FIG. 2 and that indicated by the dashed line of the same (where the flappers 38 are slightly lower than the surface of the endless belt 48 on which photographic paper is placed). Arranged between the driven roller 52 and the driving roller 54 are an intermediate roller 64 as well as a tension roller 68 for keeping the tension constant. The reference numeral 70 indicates a box for receiving finished photographic-paper sheets falling from the device.

Figure 4:
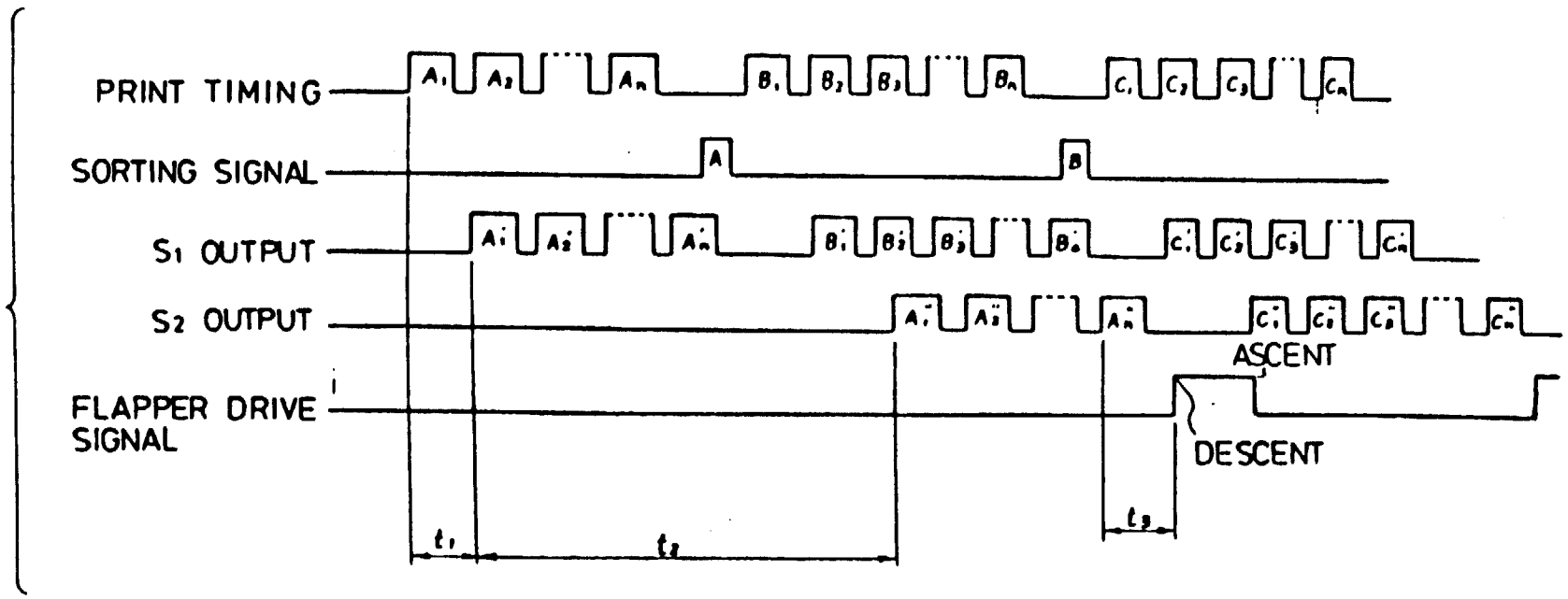
FIG. 4 is a chart showing the signal waveform in the different sections of this device.

The above-mentioned dimmer filter 18 and the black shutter 26 are connected to a control circuit 30 so that they may be controlled on the basis of exposure information. Further, the cutter 28, the motor 62, the first paper sensor S1, the second paper sensor S2, and the link sensor S3 are also connected to the control circuit 30. Connected to the control circuit 30 are a keyboard equipped with printing and sorting keys 32 to be depressed when printing and distributing photographic paper, as well as a print size setter 34 for inputting information on the size of the printed photographic paper sheets. By depressing the printing key when printing, a signal indicative of the print timing as shown in FIG. 4 is input to the control circuit 30, and, by depressing the sorting key when distributing photographic paper, a sorting signal as shown in FIG. 4 is input to the control circuit 30. When printed photographic paper passes the first and second paper sensors S1 and S2, signals as shown in FIG. 4 are output from the respective sensors.

Figure 5:
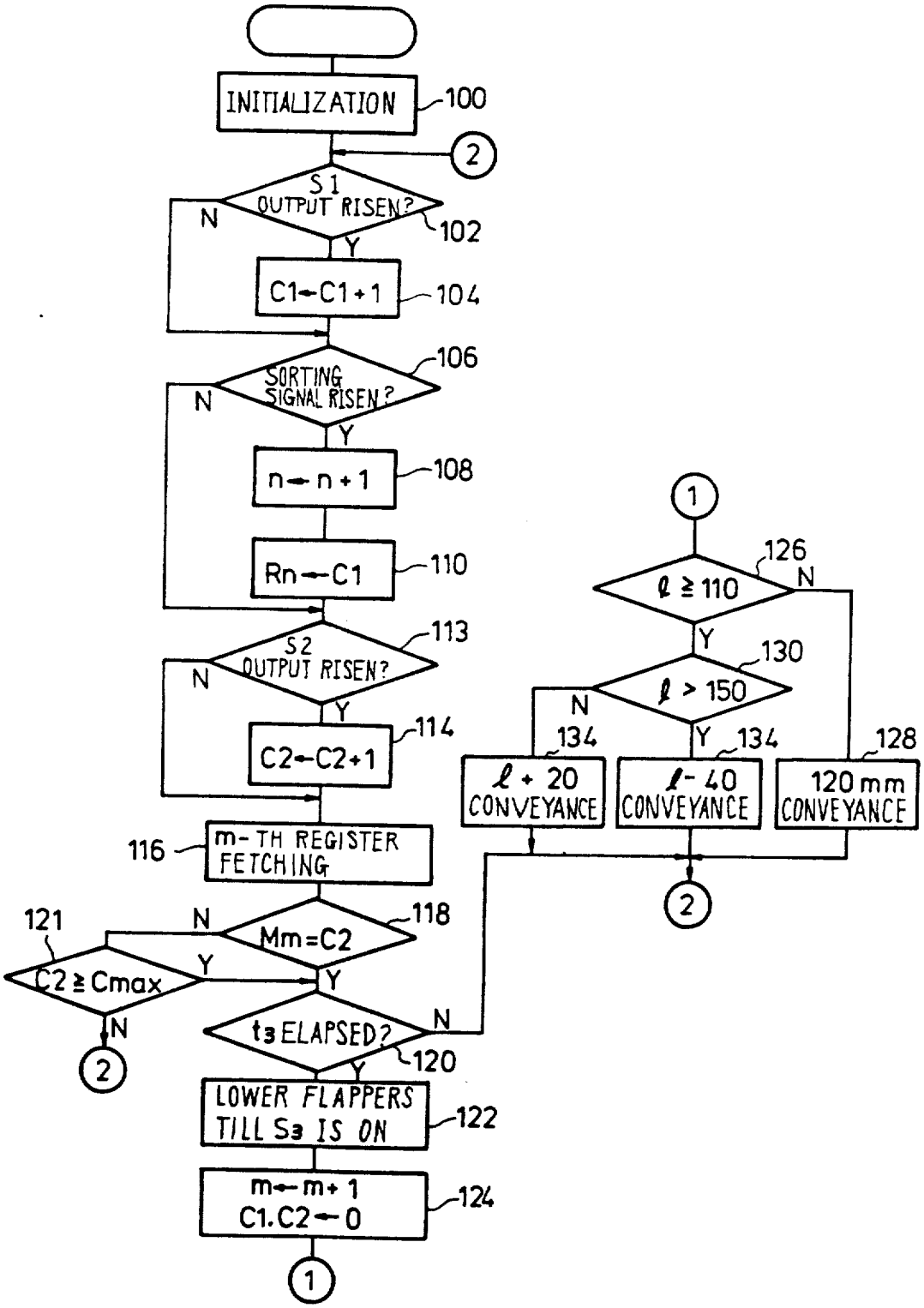
FIG. 5 is a flowchart showing the routine for the control circuit of this device, controlling the sheet conveyance effected by means of flappers and an endless belt.

Next, the drive control for the flappers 38 and the endless belt 48, effected by the control circuit 3, will be described with reference to FIG. 5. First, in Step 100, variables such as n and m are initialized. The variable n is initialized at 0, and the variable m at 1. In Step 102, whether the signal level of the output of the first paper sensor S1 has risen is determined; when it is determined to have risen, a count value C1 is incremented in Step 104. Next, in Step 106, whether the level of the sorting signal input through the sorting key has risen is determined; when it is determined to have risen, the variable n is incremented in Step 108, and, in Step 110, the count value C1 is stored in a register Rn. As a result of these operations, the number of rises in the output of the first paper sensor S1 up to the time when the sorting signal has risen, i.e., the number of sheets of photographic paper, printed and cut by the cutter 28, is stored in the registers Rn. The photographic paper which has been printed and cut into sheets undergoes the processes of development, fixing, washing and drying, and is discharged from the printer processor about five minutes afterwards.

Next, in Step 112, whether the output of the second paper sensor S2 has risen is determined; when it is determined to have risen, a count value C2 is incremented in Step 114, and then the value of the m-th register is fetched (Since the initial value of the variable m is 1, it is the value of the first register that is fetched first). When the output of the second paper sensor S2 has not risen yet, the procedure moves on to Step 116. Next, in Step 118, whether the value Mm stored in the m-th register is equal to the count value C2 is determined; when the values are determined to be equal, i.e., when the front end of the last one of the photographic paper sheets that have passed the first paper sensor S1 up to the time when the sorting signal has risen, is determined to have been detected by the second paper sensor S2, whether a period t3 has elapsed is determined in Step 120. This period t3 may be that which elapses between the time at which the front end of a photographic paper sheet reaches the second paper sensor S2 and the time at which this photographic paper sheet is completely discharged from the printer processor and placed on the flappers 38. When the period t3 is determined not to have elapsed, the procedure moves on to Step 102, and, when the period t3 is determined to have elapsed, the flappers 38 are lowered, in Step 122, by driving the motor 62 until the link sensor S3 is turned on, i.e., until the flappers 38 are lowered to a position which is slightly below the endless belt 48. Subsequently, in Step 124, the variable m is incremented in order to distribute the next group of finished photographic paper sheets, and, at the same time, the count values C1 and C2 are cleared. As a result of thus changing the variables n and m, the count values when the sorting signal has risen is stored in the registers, the register values being successively read and compared with the count value C2.

Next, in Step 126, information on the size l of the photographic paper sheets of the next group to be sorted, which has previously been input, is fetched from the print size setter 34 which consists, for example, of a key-in input device, and this size is compared with a first predetermined value (for example, 110 mm). If this size is smaller than the first predetermined value, the motor 58 is driven in Step 128 in such a manner that the endless belt 48 is moved for a predetermined distance (which corresponds, for example, to a value obtained by adding a predetermined value to the length of the flappers 38). When, in Step 126, the size l is determined to be larger than the first predetermined value, whether the size l is larger than a second predetermined value (for example, 150 mm) is determined in Step 130. When the size l of the photographic paper sheet is equal to or smaller than the second predetermined value, the motor 58 is driven in Step 134 in such a manner that the photographic paper sheet is conveyed for a distance corresponding to a value obtained by adding a predetermined value (for example, 20 mm) to the size l of the photographic-paper sheet. When the size l of the photographic-paper sheet is determined to be larger than the second predetermined value, the motor 58 is driven in Step 132 in such a manner that the photographic paper sheet is conveyed for a distance corresponding to a value obtained by subtracting a predetermined value (for example, 40 mm) from the size l of the photographic paper sheet. Thus, when the size l of the photographic paper sheet is smaller than the first predetermined value, the sheets are conveyed for a distance which is longer than the length of the flappers 38, thereby preventing interference between the photographic paper sheets and the flappers 38. When the size of the photographic paper sheet is somewhere between the first and second predetermined values, i.e., when the size of the photographic paper sheet is larger than the length of the flappers 38, the photographic paper sheets can be placed on the endless belt 48 in such a manner that the distance between piles of accumulated sheets is kept at a predetermined value (20 mm, in the above example). When the size of the photographic paper sheet is larger than the second predetermined value, the photographic paper sheets can be placed on the endless belt 48 in such a manner that the accumulated sheets overlap each other for a certain distance (20 mm, in the above example). Thus, the distance for which photographic paper sheets are conveyed is varied in accordance with the size of the photographic-paper sheets to be conveyed, which makes it possible to efficiently utilize the surface of the endless belt 48 on which finished photographic paper sheets are placed.

If, on the other hand, the determination in Step 118 is negative, whether the count value C2 is equal to or larger than the largest possible number of photographic paper sheets that can be accumulated on one area of the endless-belt surface (for example, 50) is determined; when the determination is affirmative, the flappers and the endless belt are controlled in a similar manner to that described above. Thus, finished photographic paper sheets are conveyed even when the number of accumulated sheets has attained its maximum, which prevents piles of finished photographic paper sheets from collapsing due to an excessive number of accumulated sheets.

While in the above-described embodiment size switching is effected by inputting size information to the print size setter, it is also possible to effect automatic size switching through the one-touch key-in of channels containing information preset photographic-sheet sizes or through the replacement of the lens unit 24.

While in the above-described embodiment the device for distributing finished photographic paper is arranged on the discharge side of a printer processor, this device for distributing finished photographic paper can also be associated with a processor of the type which discharges finished photographic paper after cutting by the image frame.

When the size of the photographic paper sheet is more than double the length of the flappers, the flappers, if allowed to remain in the raised position, will cause photographic paper sheets to swing on the flappers in a seesaw-like manner, which prevents their normal accumulation on the flappers. This can be coped with by setting the flappers in the raised position for only the first sheet, and retaining the flappers in the lowered position for the rest of the sheets, allowing them to accumulate directly on the first one.

What is claimed is:

1. A device for distributing finished photographic paper, comprising:

means for accumulating and transferring finished photographic paper sheets discharged in piles from a photographic paper processing apparatus;

means for conveying intermittently and concurrently a plurality of said piles of finished photographic paper sheets in series;

a first driving means for intermittently driving said conveying means a predetermined distance in accordance with the respective sizes of said finished photographic paper sheets; and a second driving means for driving said accumulation and transfer means;

whereby finished photographic paper sheets are transferred from the photographic paper processing apparatus to said conveying means after a predetermined number of sheets are accumulated in said accumulation and transfer means by means of said accumulation and transfer means, and are distributed and arranged on said conveying means.

2. A device for distributing finished photographic paper as claimed in claim 1, wherein said accumulation and transfer means consists of flappers.

3. A device for distributing finished photographic paper as claimed in claim 2, wherein said conveying means consists of a belt, and said flappers are arranged on both sides in the width directions of said belt.

4. A device for distributing finished photographic paper as claimed in claim 1, wherein said conveying means consists of a belt.

5. A device for distributing finished photographic paper comprising:

means for accumulating and transferring finished photographic paper sheets discharged from a photographic paper processing apparatus;

means for conveying intermittently a plurality of finished photographic paper sheets in series;

a first driving means for driving said conveying means;

a second driving means for driving said accumulation and transfer means; and means for controlling said second driving means in such a manner that finished photographic paper sheets are transferred to said conveying means when a predetermined number of them have been accumulated on said accumulation and transfer means, and which controls said first driving means selectively in two modes, in one of which piles of accumulated finished photographic paper sheets, when transferred to said conveying means, are allowed to have a space between them, and in the other of which they partly overlap each other;

whereby finished photographic paper sheets are transferred from the photographic paper processing apparatus to said conveying means by means of said accumulation and transfer means, and are distributed and arranged on said conveying means.

6. A device for distributing finished photographic paper as claimed in claim 5, wherein said control means controls said first driving means in such a manner that piles of finished photographic paper sheets on said conveying means are allowed to have a space between them when the size of the next finished photographic paper sheets to be sorted is relatively small, and in such a manner that piles of finished photographic paper sheets on said conveying means partly overlap each other when the size of the next finished photographic-paper sheets to be sorted is relatively large.

7. A device for distributing finished photographic paper as claimed in claim 5, wherein said control means further controls said second driving means in such a manner that the movement of said accumulation and transfer means is changed in conformance with the size of the finished photographic-paper sheets.

8. A device for distributing finished photographic paper, comprising:

means for accumulating and transferring finished photographic paper sheets discharged from a photographic paper processing apparatus;

means for conveying intermittently a plurality of finished photographic paper sheets in series;

a first driving means for driving said conveying means; and a second driving means for driving said accumulation and transfer means;

whereby finished photographic paper sheets are transferred from the photographic paper processing apparatus to said conveying means by means of said accumulation and transfer means, and are distributed and arranged on said conveying means; and wherein said accumulation and transfer means consists of flappers, wherein said flappers are capable of swinging, and wherein cams for swinging said flappers are connected to said second driving means.

9. A device for distributing finished photographic paper, comprising:

flappers for accumulating and transferring finished photographic paper sheets discharged from a photographic paper processing apparatus;

a conveying belt for conveying intermittently a plurality of finished photographic paper sheets in series;

a first driving device for driving said conveying belt;

a second driving device for driving said flappers; and a control device which controls said second driving device in such a manner that finished photographic paper sheets are transferred to said conveying belt when a predetermined number of them have been accumulated on said flappers, and which controls said first driving device selectively in two modes, in one of which piles of accumulated finished photographic paper sheets, when transferred to said conveying belt, are allowed to have a space between them, and in the other of which they partly overlap each other;

whereby finished photographic paper sheets are transferred from the photographic paper processing apparatus to said conveying belt by means of said flappers, and are distributed and arranged on said conveying belt.

10. A device for distributing finished photographic paper as claimed in claim 9, wherein said control device controls said first driving device in such a manner that piles of finished photographic paper sheets on said conveying belt are allowed to have a space between them when the size of the next finished photographic paper sheets to be sorted is relatively small, and in such a manner that piles of finished photographic paper sheets on said conveying belt partly overlap each other when the size of the next finished photographic paper sheets to be sorted is relatively large.

11. A device for distributing finished photographic paper as claimed in claim 9, wherein said control device further controls said second driving device in such a manner that the movement of said flappers is changed in conformance with the size of the finished photographic paper sheets.

12. A device for distributing finished photographic paper as claimed in claim 9, wherein said flappers are arranged on both sides in the width direction of said conveying belt.

13. A device for distributing finished photographic paper as claimed in claim 9, wherein said flappers are capable of swinging, and wherein cams for swinging said flappers are connected to said second driving device.

14. A method of distributing finished photographic paper of the type in which finished photographic paper sheets discharged from a photographic paper processing apparatus are transferred by means of an accumulation and transfer means driven by a second driving means to a conveying means driven by a first driving means, and are distributed and arranged on said conveying means, comprising the steps of:

transferring finished photographic paper sheets to said conveying means when a predetermined number of them have been accumulated on said accumulation and transfer means; and arranging the finished photographic paper sheets on said conveying means selectively in two modes, in one of which the finished photographic paper sheets, when transferred to said conveying means, are allowed to have a space between them, and in the other of which they partly overlap each other.

15. A method distributing finished photographic paper as claimed in claim 14, wherein said step of arranging the finished photographic paper sheets on said conveying means selectively in two modes is performed in such a manner that piles of finished photographic paper sheets on said conveying means are allowed to have a space between them when the size of the next finished photographic paper sheets to be sorted is relatively small, and in such a manner that piles of finished photographic paper sheets on said conveying means partly overlap each other when the size of the next finished photographic paper sheets to be sorted is relatively large.

16. A method of distributing finished photographic paper as claimed in claim 14, wherein the movement of said accumulation and transfer means is changed in conformance with the size of the finished photographic paper sheets.

17. A method of distributing finished photographic paper as claimed in claim 14, wherein said step of transferring finished photographic paper sheets to said conveying means is effected by making said accumulation and transfer means capable of swinging, and causing said accumulation and transfer means to swing by means of said second driving means.

* * * * *